US006246388B1

(12) United States Patent
Motegi et al.

(10) Patent No.: US 6,246,388 B1
(45) Date of Patent: Jun. 12, 2001

(54) DISPLAY DRIVING CIRCUIT FOR DISPLAYING CHARACTER ON DISPLAY PANEL

(75) Inventors: Syuji Motegi, Ashikaga; Hiroyuki Arai; Tetsuya Tokunaga, both of Gunma-ken, all of (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/309,035

(22) Filed: May 10, 1999

(30) Foreign Application Priority Data

May 14, 1998 (JP) ..... 10-132121

(51) Int. Cl.[7] ..... G09G 3/36

(52) U.S. Cl. ..... 345/98; 345/100; 345/141; 345/511

(58) Field of Search ..... 345/197, 192, 345/196, 508, 98, 99, 100, 141

(56) References Cited

U.S. PATENT DOCUMENTS 4,692,859 9/1987 Russell .
5,270,696 * 12/1993 Shin et al. ..... 345/98
6,097,362 * 8/2000 Kim ..... 345/87
6,147,667 * 11/2000 Yamazaki et al. ..... 345/98
6,160,535 * 12/2000 Park ..... 345/98

FOREIGN PATENT DOCUMENTS 0 656 726 6/1995 (EP) .
1 603 836 12/1981 (GB) .
97-06482 2/1997 (WO) .

* cited by examiner

*Primary Examiner*—Kent Chang
(74) *Attorney, Agent, or Firm*—Hogan & Hartson, LLP

(57) ABSTRACT

For changing the content of a display RAM (38) or an accessory RAM (39), various data SDI, such as an instruction code, address data, display data, is initially transferred to a shift register (11). Then, the display data in the shift register (11) is latched by a latch circuit (62). A write operation is carried out during a period from the completion of a shift operation by the shift register (11) using various data SDI in connection with the current display to the completion of a shift operation using various data SDI in connection with the next display, i.e., a period with an operation enable signal CE remaining at an L or H level. As a result, time allowance for writing is ensured, which contributes to reduction of software processing load by an external device.

6 Claims, 12 Drawing Sheets

DISPLAY DRIVING CIRCUIT FOR DISPLAYING CHARACTER ON DISPLAY PANEL

BACKGROUND OF THE INVENTION

1. Field of the Invention

The present invention relates to a display driving circuit or displaying a predetermined character on a display panel.

2. Description of the Related Art

FIG. 8 is a block diagram showing a conventional display driving circuit formed integrated on a single chip.

The drawing includes an interface circuit 1 for receiving from an external device (such as a microcomputer) an operation enable signal CE, a clock signal CL, and various data DI for writing.

FIG. 9 shows a specific example of an interface circuit 1. In the drawing, an address register 2 holds address data (e.g., eight bits) in synchronism with a clock signal CL when a chip enable signal CE is at an L level (low level), the address data serving as the key to the operation of the circuit shown in FIG. 8. An address decoder 3 determines whether or not the value of the address register 2 is normal, and outputs "H" (high-level) when the value is determined to be normal. Upon completion of the determination by the address decoder 3, an operation enable signal CE is changed from L to H level. An operation enable signal CE is supplied to one of the input terminals of an AND gate 4, and also to another input terminal thereof via a delay circuit 5 and an inverter 6. That is, when the operation enable signal CE rises from L to H level, the AND gate 4 outputs an H pulse signal. Meanwhile, an operation enable signal CE is also supplied to one of the input terminals of an OR gate 7 and as well as to another input terminal thereof via the delay circuit 5 and the inverter 6. That is, when the operation enable signal CE falls from H to L level, the OR gate 7 outputs an L pulse signal. A D-type flip flop 8 is connected via the D terminal thereof to an output terminal of the address decoder 3, via the C terminal thereof to an output terminal of the AND gate 4, and via the R terminal thereof to an inverted signal of an output from the OR gate 7. Thus, when an operation enable signal CE changes from L to H level, the D-type flip flop 8 holds an H output from the address decoder 3, so that AND gates 9 and 10 are caused to be in an open state. Then, the AND gate 9 outputs various data DI (hereinafter referred to as SDI) for writing into a subsequent memory, and the AND gate 10 outputs a clock signal CL (hereinafter referred to as SCL). An output from the interface circuit 1 is supplied to a shift register (e.g., 24 bits) such that various data SDI is supplied to the shift register in synchronism with a clock signal SCL. When all bits of the various data SDI have been supplied to the shift register, an operation enable signal CE changes from H to L level, and the D-type flip flop 8 is reset. Accordingly, the AND gates 9 and 10 are caused to be in a closed state, thereby suspending shift operation of the shift register.

Referring again to FIG. 8, a shift register 11, corresponding to the above mentioned shift register, serially receives various data SDI for a write of data into the memory (24 bits; D0 to D23) in synchronism with a clock signal SCL during a period when an operation enable signal CE remains at an H level. The shift register 11 is constituted as 24 D-type flip-flops connected in a cascade manner, and employs a serial input and a parallel output format. Note that various data SDI includes address data, display data, an instruction code, and so on.

A character generator ROM 12 stores character data (e.g., 5×7 dots (horizontal×vertical)) concerning a character to be displayed on a display panel (not shown). Note that the character generator ROM 12 is a non-volatile memory, such as a mask ROM, and is pre-stored, during manufacturing, with character data that is less likely to change. A character generator RAM 13 stores character data concerning other characters to be displayed on the display panel, similar to the character generator ROM 12. Note that the character generator RAM 13 is a volatile memory, such as an SRAM, and stores character data that are very likely to change depending on the situation, under control of an external device. A display RAM 14 stores a character code for designating an address in the character generator ROM 12 or the character generator RAM 13, with an address defined corresponding to each column of a display panel. For example, in the case of a display panel having 64 columns, when the address in the display RAM 14 corresponding to the first column of the display panel is 00H (H: hexadecimal), the address which corresponds to the 64th column is 3FH resulting from incremental addition. An accessory RAM 15 stores accessory data indicative of information other than characters to be displayed on the display panel with an address defined corresponding to each column of a display panel. For example, in the case of 16 types of available accessory information, when the address in the accessory RAM 15 corresponding to the first column of a display panel is OH, the address which corresponds to the 16th column is FH resulting from incremental addition. Note that the accessory RAM 15 is a volatile memory, such as an SRAM, similar to the character generator RAM 13, and the accessory data stored therein can be rewritten as required.

An address counter 16 for use in reading a character code and accessory data supplies address data DCRDA0 to DCRDA5, each being six bits, to the display RAM 14, and address data ADRDA0 to ADRDA3, each being four bits, to the accessory RAM 15.

An instruction decoder 17 generates an instruction signal WCCK for writing character data into the character generator RAM 13, an instruction signal WDCK for writing a character code into the display RAM 14, and an instruction signal WACK for writing accessory data into the accessory RAM 15.

FIG. 10 shows a specific example of an instruction decoder 17. A decoder 18 selectively generates any one of the signals WCENB, WDENB, and WAENB according to the result of decoding the instruction code D20 to D23 supplied from the shift register 11, the signals WCENB, WDENB, and WAENB being used as a base in preparing instruction signals WCCK, WDCK, and WACK. An output DIENB from the D-type flip flop 8 in the interface circuit 1 is supplied to one of the input terminals of a NOR gate 19, and also to another input terminal thereof via a delay circuit 20 and an inverter 21. That is, when a signal DIENB changes from H to L level after completion of shift operation using 24 bits by the shift register 11, the NOR gate 19 outputs an H pulse signal. An output from the NOR gate 19 is supplied to one of the input terminals of each of the AND gates 22, 23, and 24, while the signals WDENB, WAENB, and WCENB from the decoder 18 are supplied to other input terminals of the AND gates 22, 23, and 24, respectively. That is, instruction signals WDCK, WACK, and WCCK are output from the AND gates 22, 23, and 24, respectively, only during a period when an output from the NOR gate 19 remains at an H level.

FIG. 11 shows a specific example of a display RAM 14. A volatile cell array 25 has a read enable terminal OE, a write enable terminal WE, address terminals A0 to A5, and data input/output terminals IO0 to IO7. Switching circuits

26-0 to 26-5 each comprise two AND gates and one OR gate. One of the two AND gates of each of the switching circuits 26-0 to 26-5, i.e., the one shown above in each pair in the drawing, receives via one input terminal thereof corresponding read address data DCRDA0 to DCRDA 5, and receives via another input terminal thereof a switching signal DCRWCT. The AND gate shown below in each pair in the drawing receives via one input terminal thereof corresponding write address data D8 to D13 from the shift register 11, and receives via another input terminal thereof an inverted signal of a switching signal DCRWCT. Latch circuits 27-0 to 27-5 each receive via an L terminal thereof an output from the OR gate of the corresponding switching circuit 26-0 to 26-5, and via a C terminal thereof a clock signal DCLCK, and supply via a Q terminal thereof an output to corresponding address terminal A0 to A5 of the cell array 25. A write enable signal generation circuit 28 generates a write enable signal DCWE at a predetermined timing in response to an instruction signal WDCK supplied from the instruction decoder 17, and supplies the signal DCWE to the write enable terminal WE. A character code D0 to D7 from the shift register 11 is input to the data input/output terminals IO0 to IO7 via buffers 29-0 to 29-7, respectively.

For reading a character code from the display RAM 14, a switching signal DCRWCT becomes H level, upon which address data DCRDA0 to DCRDA5 from the address counter 16 are selectively output from the switching circuits 26-0 to 26-5, and then latched, when a clock signal DCLCK thereafter becomes H level, by the latch circuit 27-0 to 27-5 whereby an address corresponding to the address data DCRDA0 to DCRDA 5 among all addresses in the display RAM 14 is designated. Subsequently, when the read enable signal DCOE becomes H level, a character code consisting of DCDT0 to DCDT 7 is read from the designated address in the display RAM 14. Note that since the buffers 29-0 to 29-7 are in a high impedance state due to the switching signal DCWRDT which is then at an L level, a character code of DCDT0 to DCDT7 when reading does not interfere with a character code D0 to D7 when writing.

For writing a character code into the display RAM 14, a switching signal DCRWCT becomes L level, upon which address data D8 to D13 from the shift register 11 are output from the switching circuits 26-0 to 26-5, and then latched, when a clock signal DCLCK thereafter becomes H level, by the latch circuits 27-0 to 27-5 whereby an address corresponding to the address data D8 to D13 among all addresses in the display RAM 14 is designated. Subsequently, when the write enable signal DCWE becomes H level, a character code D0 to D 7 is written into the designated address in the display RAM 14.

FIG. 12 shows a specific example of an accessory RAM 15. A volatile cell array 30 has a read enable terminal OE, a write enable terminal WE, address terminals A0 to A3, and data input/output terminals IO0 to IO4. Switching circuits 31-0 to 31-3 each comprise two AND gates and one OR gate. One of the two AND gates of each switching circuits 31-0 to 31-3, i.e., the one shown above in the drawing, receives via one input terminal thereof corresponding read address data ADRDA0 to ADRDA 3, and receives via another input terminal thereof an inverted signal of a switching signal ADRWCT. The AND gate shown below in each pair in the drawing receives via one input terminal thereof corresponding write address data D8 to D11 from the shift register 11, and also receives via another input terminal thereof an inverted signal of a switch signal ADRWCT. Latch circuits 32-0 to 32-3 each receive via an L terminal thereof an output from the OR gate of a corresponding switching circuit 31-0 to 31-3, and via a C terminal thereof a clock signal ADLCK, and supply via a Q terminal thereof an output to corresponding address terminal AO to A3 of the cell array 30. A read enable signal ADOE is supplied to the read enable terminal OE. A write enable signal generation circuit 33 generates a write enable signal ADWE at a predetermined timing in response to a supplied instruction signal WACK from the instruction decoder 17, and supplies the signal ADWE to the write enable terminal WE. Accessory data D0 to D4 from the shift register 11 are supplied to corresponding data input/output terminals IO0 to IO4 via buffers 33-0 to 33-4, respectively.

For reading accessory data from the accessory RAM 15, a switching signal ADRWCT becomes H level, upon which address data ADRDA0 to ADRDA3 from the address counter 16 are selectively output from the switching circuits 31-0 to 31-3, and then latched, when a clock signal ADLCK thereafter becomes H level, by the latch circuits 32-0 to 32-3 whereby an address corresponding to the address data of ADRDA0 to ADRDA3 among all addresses in the accessory RAM 15 is designated. Subsequently, when the read enable signal ADOE becomes H level, accessory data of ADDT0 to ADDT4 is read from the designated address in the accessory RAM 15. Note that since the buffers 33-0 to 33-4 are in a high impedance state due to the signal ADWRDT which is then at an L level, accessory data ADDT0 to ADDT4 when reading do not interfere with accessory data D0 to D4 when writing.

For writing accessory data into the accessory RAM 15, a switching signal ADRWCT becomes L level, upon which address data D8 to D11 from the shift register 11 are output from the switching circuits 31-0 to 31-3, and then latched, when a clock signal ADLCK thereafter becomes H level, by the latch circuits 32-0 to 32-3 whereby an address corresponding to the address data D8 to D11 among all addresses in the accessory RAM 15 is designated. Subsequently, when the write enable signal ADWE becomes H level, accessory data D0 to D4 are written into the designated address in the accessory RAM 15.

Note that all 24 bit data held in the shift register 11 is changed prior to writing of a character code and accessory data into the display RAM 14 and the accessory RAM 15, respectively.

Referring again to FIG. 8, a display panel has, for example, 60 segment electrodes and eight common electrodes arranged in a matrix thereon. That is, for a character font consisting of 5×7 (horizontal×vertical) dots, twelve characters can be displayed on such a display panel as one common electrode is used for displaying accessory information. A latch circuit 34 latches information to be displayed in one horizontal line on the display panel from the character generator ROM 12, the character generator RAM 13, and the accessory RAM 15. A segment driving circuit 35, whose output terminals SEG1 to SEG 60 are connected to the sixty segment electrodes of the display panel, outputs a driving signal for turning on/off light to the segment electrodes. A common driving circuit 36, whose output terminals COMI to COM 8 are connected to the eight common electrodes of the display panel, sequentially outputs a driving signal with a predetermined frequency for activating the segment electrodes. A timing signal generation circuit 37 synchronizes respective blocks of the circuit to ensure reliable displaying of character and accessory information on the display panel.

Here, in order to change character and accessory information which is displayed on a 60×80 (horizontal×vertical) dot region on the display panel according to generated segment driving signals SEG1 to SEG 60 and common driving signals COM1 to COM8, the content of the display RAM 14 and the accessory RAM 15 must be changed. In other words, the content of the shift register 11 must be changed. Therefore, in order to change the information being displayed on the display panel in each column, address data must be continuously transferred to the shift register 11 even after a character code or accessory data has been written at the write start address in the display RAM 14 or the accessory RAM 15, the address data being obtained through incremental addition to the write start address.

Here, a conventional circuit 1 is such that a write operation with respect to the display RAM 14 and the accessory RAM 15 begins upon completion of shift operation by the shift register 11. In other words, shift operation by the shift register 11 is carried out during a period with an operation enable signal CE remaining H level, and write operation with respect to the display RAM 14 and the accessory RAM 15 is carried out during a period with an operation enable signal CE remaining L level. That is, time for write operation with respect to the display RAM 14 and the accessory RAM 15 is limited, resulting in a problem of inefficient writing. In particular, write processing may be unable to catch up with a significant change, if such occurs, to display information.

SUMMARY OF THE INVENTION

The present invention has been conceived to overcome the above problems and aims to provide a display driving circuit capable of following a significant change of display information.

In the present invention, there is provided a latch circuit between a shift register and a display memory, for latching display data from the shift register after completion of data input to the shift register so that display data can be input from the latch circuit to the display memory. This arrangement allows parallel execution of display data input to the shift register and display data writing from the latch circuit to the display memory. As a result, time allowance for writing can be produced when the content of the display memory is changed using an external device, which enables reduction of the software processing load by the external device. Also, the circuit of the present invention is preferably applied to a device with a high display speed, as the circuit enables high speed writing of display data.

Further, preferably, address data indicative of a write start address for the display data may be input to the shift register as well as the display data so that a write address can be determined. When the write address is input into the address counter, the first write address in the display memory is designated, and thereafter the write address is incremented to generate a write address in the display memory for subsequent data. With this arrangement, it is unnecessary to input address data in the second and subsequent data input to the shift register.

Still further, preferably, instruction data including a write instruction for display data may be input to the shift register together with the display data and the address data so that starting and ending of a write operation using the display data can be controlled.

BRIEF DESCRIPTION OF THE DRAWINGS

The above and other objects, features, and advantages of the present invention will become further apparent from the following description of the preferred embodiment taken in conjunction with the accompanying drawings wherein.

DESCRIPTION OF THE PREFERRED EMBODIMENTS

The present invention will be described in detail referring to the accompanying drawings.

Figure 1:
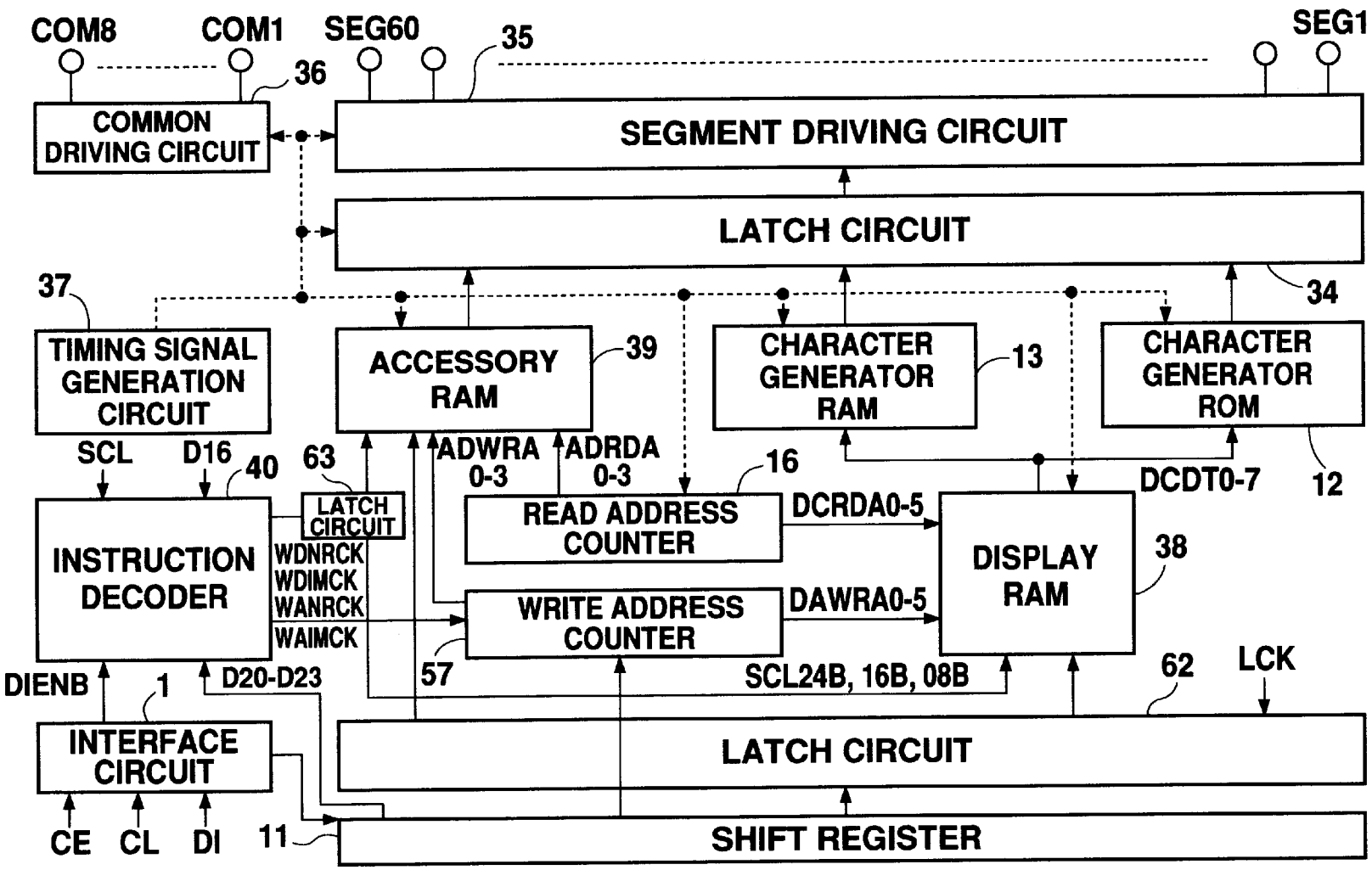
FIG. 1 is a block diagram showing a display driving circuit of the present invention.
Figure 8:
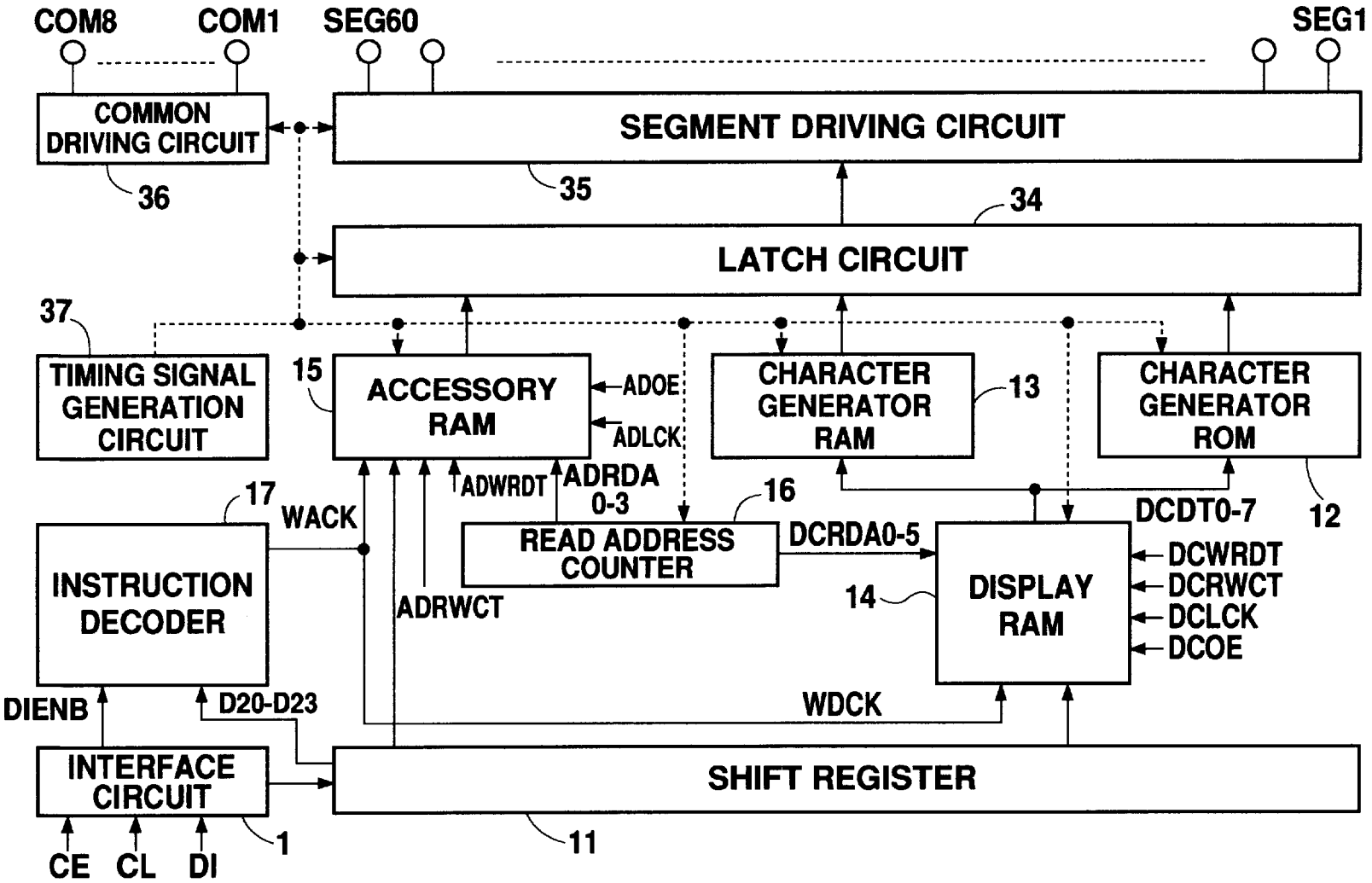
FIG. 8 is a block diagram showing a conventional display driving circuit.
Figure 9:
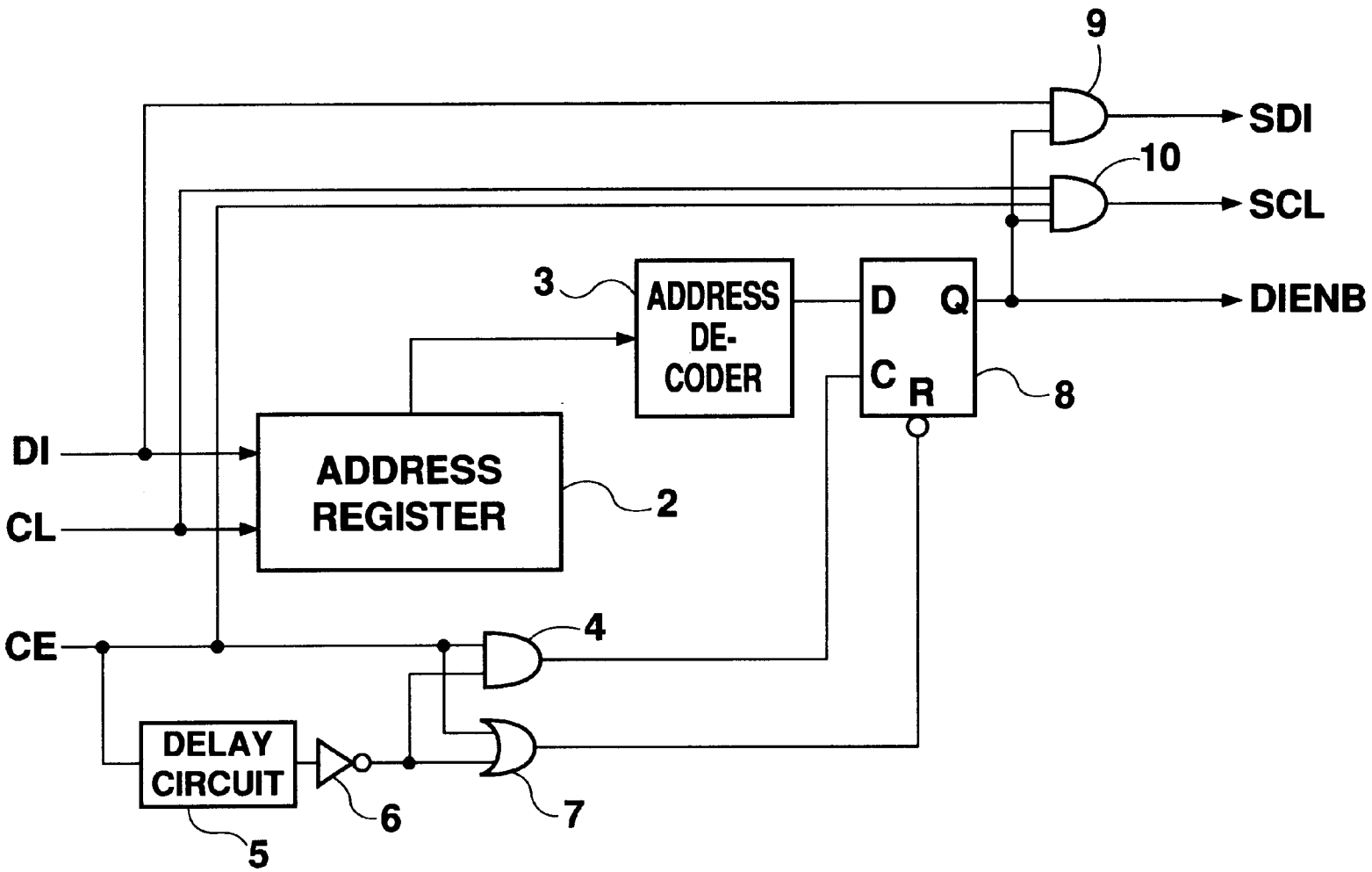
FIG. 9 is a diagram showing in detail the interface circuit shown in FIGS. 1 and 8.

FIG. 1 is a block diagram showing a display driving circuit according to the present invention, in which identical blocks to those shown in FIG. 8 are given identical reference numerals and their explanations will not be repeated here.

A display RAM 38 stores a character code for designating an address in the character generator ROM 12 or the character generator RAM 13, with an address defined corresponding to each column of a display panel. For example, in the case of a display panel having 64 columns, when the address in the display RAM 38 corresponding to the first column in the display panel is 00H (H: hexadecimal), the address corresponding to the 64th column is 3FH resulting from incremental addition. An accessory RAM 39 stores accessory data indicative of information other than characters to be displayed on the display panel, with an address defined corresponding to each column of a display panel. For example, in the case of 16 types of available accessory information, when the address in the accessory RAM 39 corresponding to the first column of the display panel is 0H, the address corresponding to the 16th column is FH resulting from incremental addition. Note that the accessory RAM 39 is a volatile memory, such as an SRAM, similar to the character generator RAM 13, and the accessory data stored therein can be rewritten as required.

A latch circuit 62 having 24 bits latches data from the shift register 11 in synchronism with a rise of a signal LCK (described later).

An instruction decoder 40 generates an instruction signal for rewriting the contents of the character generator RAM 13, the display RAM 38, or the accessory RAM 39 according to the result of decoding the instruction code D20 to D23 supplied from the shift register 11.

Figure 2:
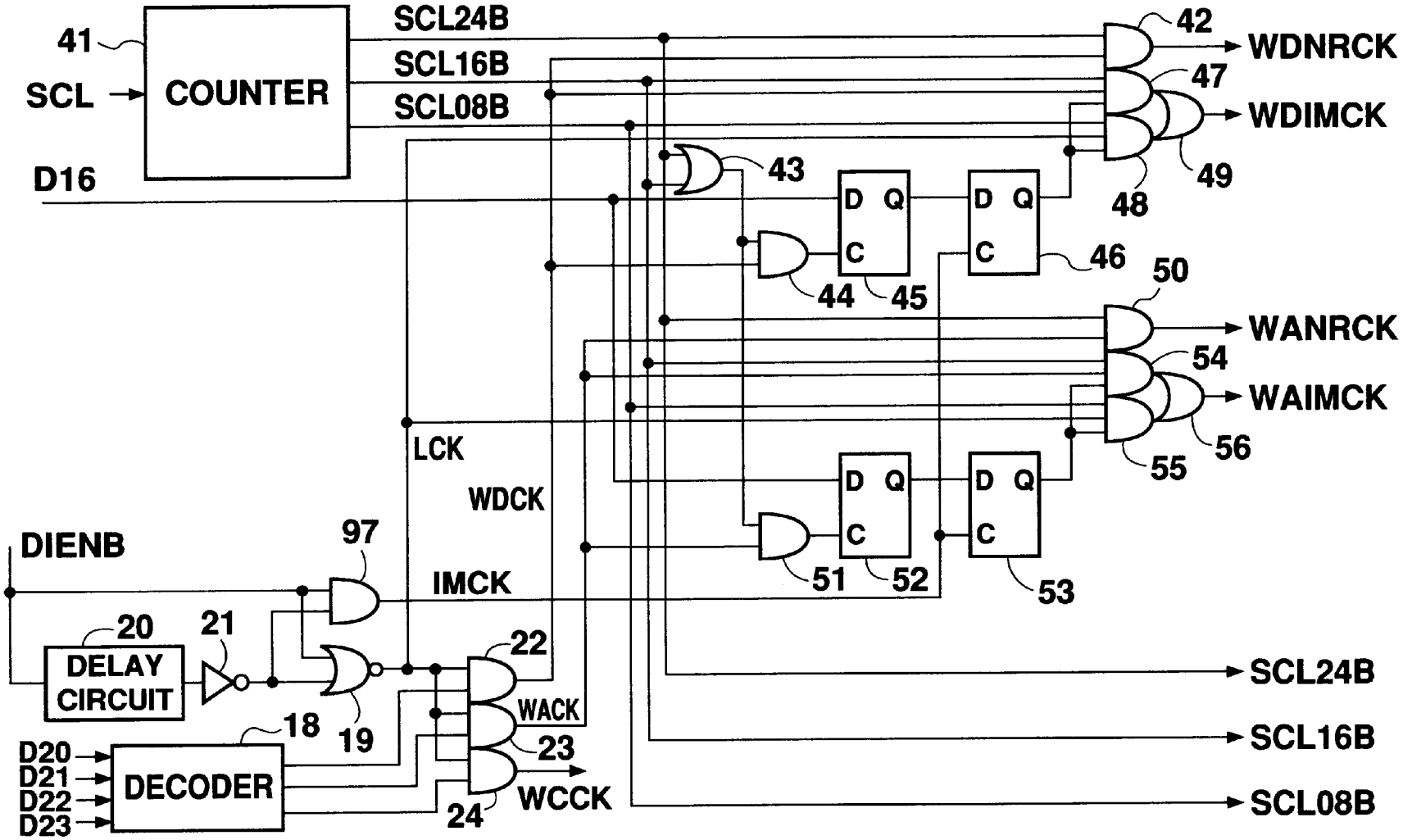
FIG. 2 is a diagram showing in detail the instruction decoder shown in FIG. 1.
Figure 10:
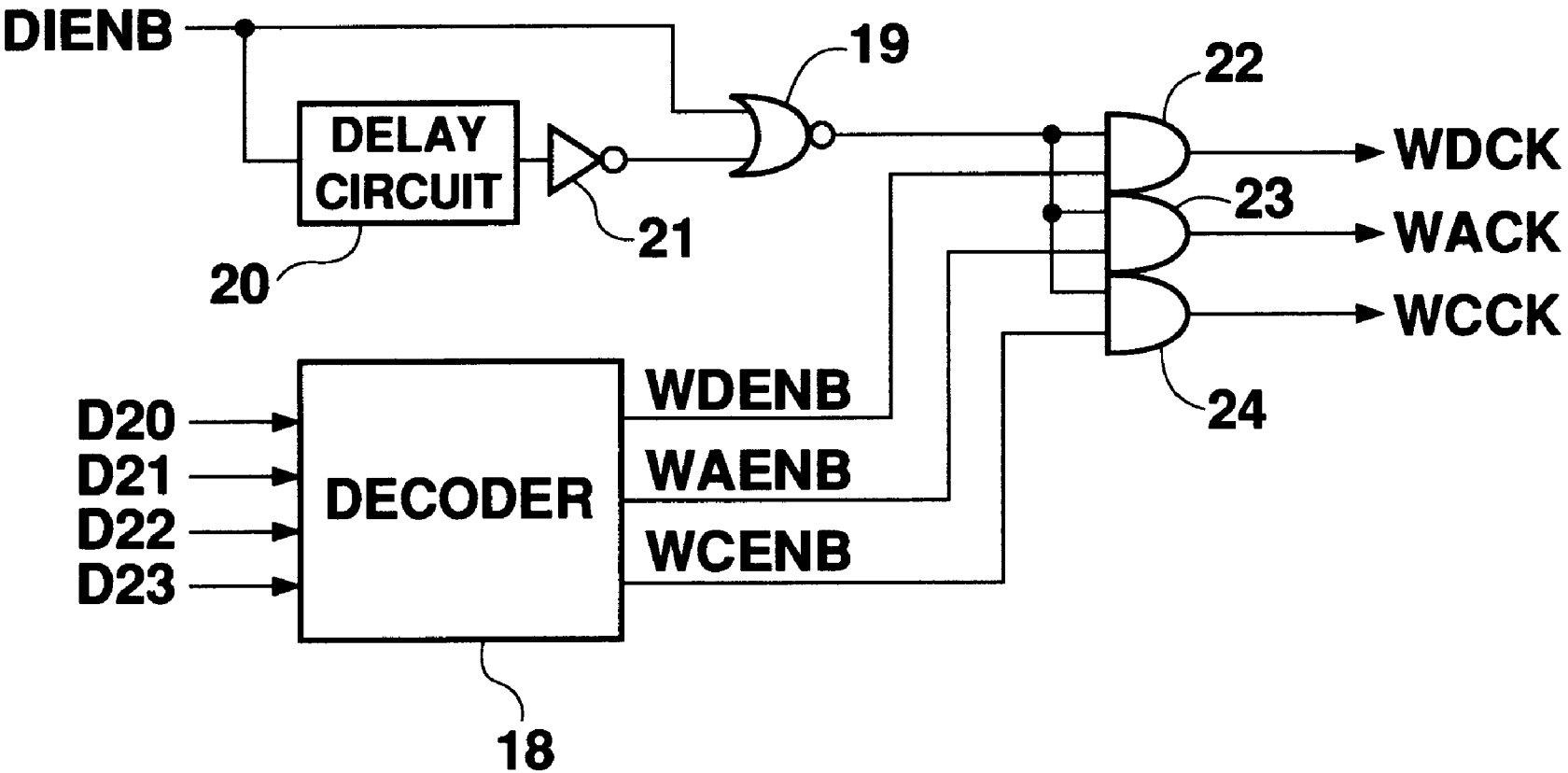
FIG. 10 is a diagram showing in detail the instruction decoder shown in FIG. 8.

FIG. 2 shows a specific example of an instruction decoder 40, in which identical members to those shown in FIG. 10 will be given identical reference numerals and their explanation will not be repeated here. A counter 41 counts clock signals SCL supplied from the AND gate 10 in the interface circuit 1. In other words, the counter 41 counts the bit number of various data SDI being serially transferred to the shift register 11. The counter 41 outputs a signal SCL24B when it has counted twenty-four clock signals SCL, signal SCL16B when it has counted sixteen clock signals SCL, and a signal SCL08B when it has counted eight clocks signals SCL. Note that the counter 41 generates any one of the signals SCL24B, SCL16B, and SCL08B. The current signal will lapse upon generation of a new signal. A control bit D16 is a bit contained in various data SDI to be serially transferred to the shift register 11, and becomes L level while address data concerning the display RAM 38 or the accessory RAM 39 is supplied to the shift register 11, and H level when it is not.

When an instruction signal WDCK is generated following the fall of a signal DIENB, and a signal SCL24B is also generated, an instruction signal WDNRCK is output from an AND gate 43 so that address data concerning the display RAM 38 is supplied to the shift register 11 in the form of being added to a character code.

The signals SCL24B and SCL16B are supplied via an OR gate 43 5 to one of the input terminals of an AND gate 44, while the instruction signal WDCK is supplied to another input terminal thereof. A D-type flip flop 45 holds a control bit D16 in synchronism with an output from the AND gate 44. A D-type flip flop 46 holds an output from the D-type flip flop 45 in synchronism with an output signal IMCK from an AND gate 97 which is output in response to the rise of a signal DIENB. That is, an output from the D-type flip flop 46 becomes either H or L level when a signal IMCK is generated within a generation period for a signal SCL24B or SCL16B. When an instruction signal WDCK is generated and a signal SCL16B is also generated while an output from the D-type flip flop 46 remains H level, the AND gate 47 outputs an instruction signal WDIMCK for incrementing an address in the display RAM 38 by one. When an output LCD is generated from the NOR gate 19 and a signal SCL08B is also generated while an output from the D-type flip flop 46 remains H level, an instruction signal WDIMCK is output also from the AND gate 48. Accordingly, instruction signals WDIMCK from the AND gates 47 and 48 are output via an OR gate 49.

When an instruction signal WACK is generated following the fall of a signal DIENB, and a signal SCL24B is also generated, an instruction signal WANRCK is output from an AND gate 50 so that address data concerning the accessory RAM 39 is supplied to the shift register 11 in the form of being attached to the accessory data.

The signal SCL24B and the signal SCL16B are supplied via an OR gate 43 to one of the input terminals of the AND gate 51, while the instruction signal WACK is supplied to another input terminal thereof. A D-type flip flop 52 holds a control bit D16 in synchronism with an output from the AND gate 51. A D-type flip flop 53 holds an output from the D-type flip flop 52 in synchronism with an output signal IMCK from the AND gate 47 which is output in response to the rise of a signal DIENB. That is, an output from the D-type flip flop 53 becomes either H or L level when a signal IMCK is generated within a generation period for a signal SCL24B or SCL16B. When an instruction signal WACK is generated and a signal SCL16B is also generated while an output from the D-type flip flop 53 remains H level, an instruction signal WAIMCK is output from the AND gate 54 so that an address in the accessory RAM 39 is incremented by one. Alternatively, when an output signal LCK from the NOR gate 19 is generated while an output from the D-type flip flop 53 remains H level, and a signal SCL08B is also generated, an instruction signal WAIMCK is also output from the AND gate 55. Accordingly, an instruction signal WAIMCK from the AND gates 54 and 55 is output via an OR gate 56.

A three-bit latch circuit 63 latches signals SCL24B, SCL16B, SCL08B in synchronism with the rise of a signal LCK. Note that the latch circuit 63 synchronizes changes of an operation enable signal CE, signals SCL24B, SCL16B, and SCL08B. In other words, the latch circuit 63 prevents signals SCL24B, SCL16B, SCL08B from being changed while an operation enable signal CE remains at an H level so as to ensure a condition enabling a write operation.

An address counter 57 is used for writing a character code and accessory data, and, specifically, supplies address data DCWRA0 to DCWRA5, each being six bits, to the display RAM 38, and address data ADWRA0 to ADWRA3, each being four bits, to the accessory RAM 39.

Figure 3:
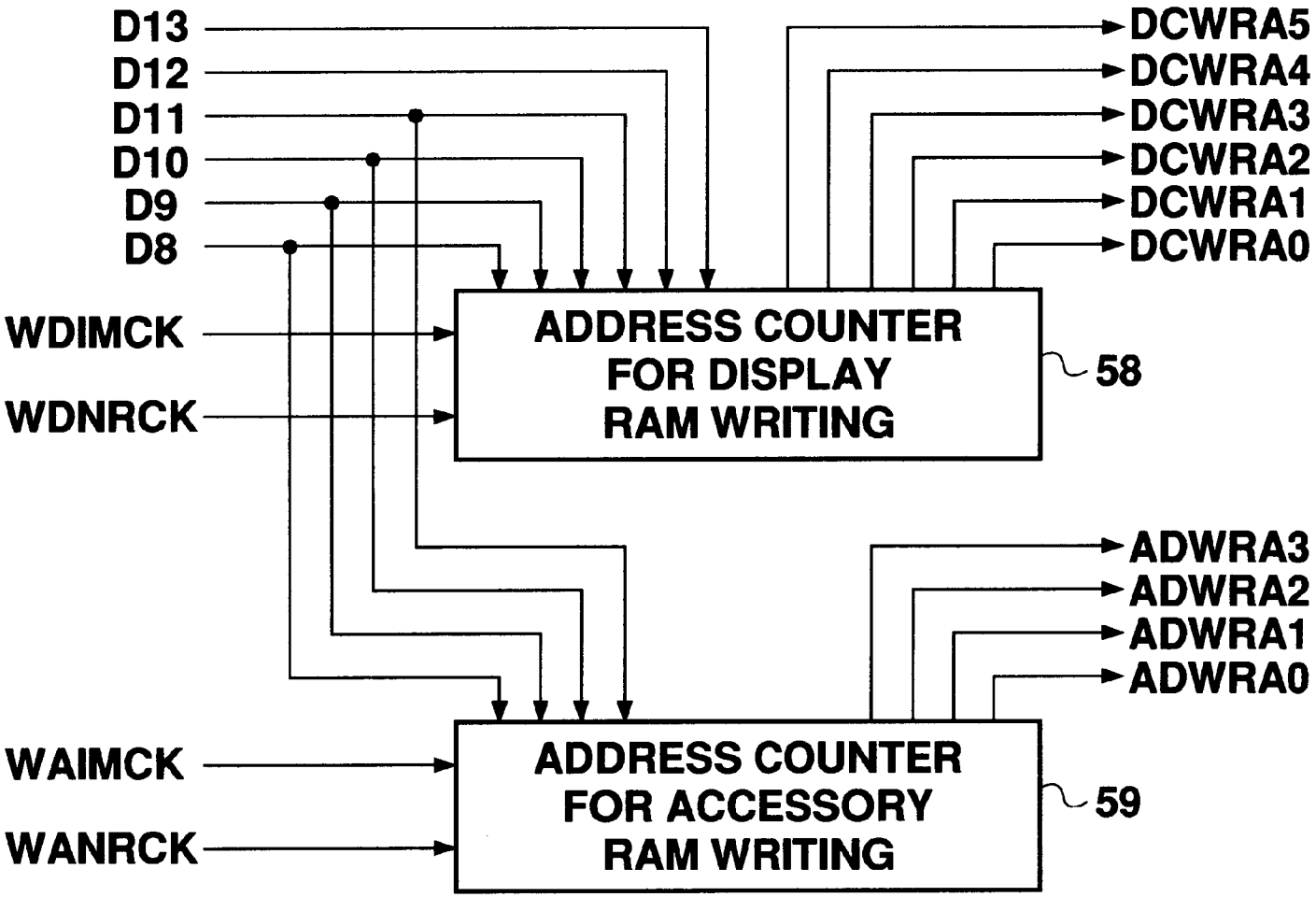
FIG. 3 is a diagram showing in detail the address counter shown in FIG. 1.

FIG. 3 shows a specific example of a write address counter 57. An address counter 58, dedicated to the display RAM 38, outputs address data D8 to D13 supplied from the shift register 11 intact as DCWRA0 to DCWRA5 when it has received an instruction signal WDNRCK, and outputs address data DCWRA0 to DCWRA5 with an increment by one when it has received an instruction signal WDIMCK. An address counter 59, dedicated to the accessory RAM 39, outputs address data D8 to D11 supplied from the shift register 11 intact as ADWRA0 to ADWRA3 when it has received an instruction signal WANRCK, and outputs address data ADWRA0 to ADWRA3 with an increment by one when it has received an instruction signal WAIMCK.

Figure 4:
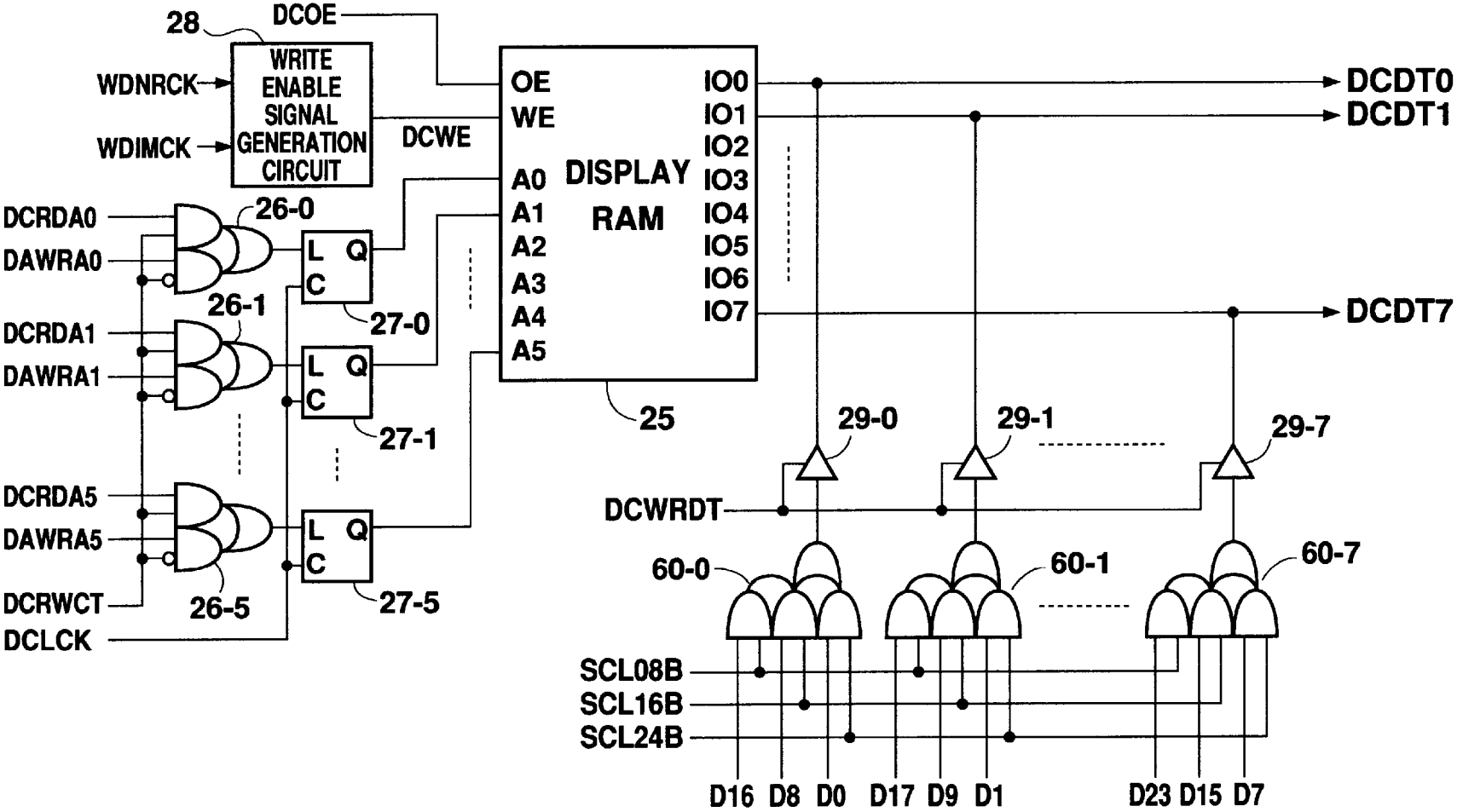
FIG. 4 is a diagram showing in detail the display RAM shown in FIG. 1.
Figure 11:
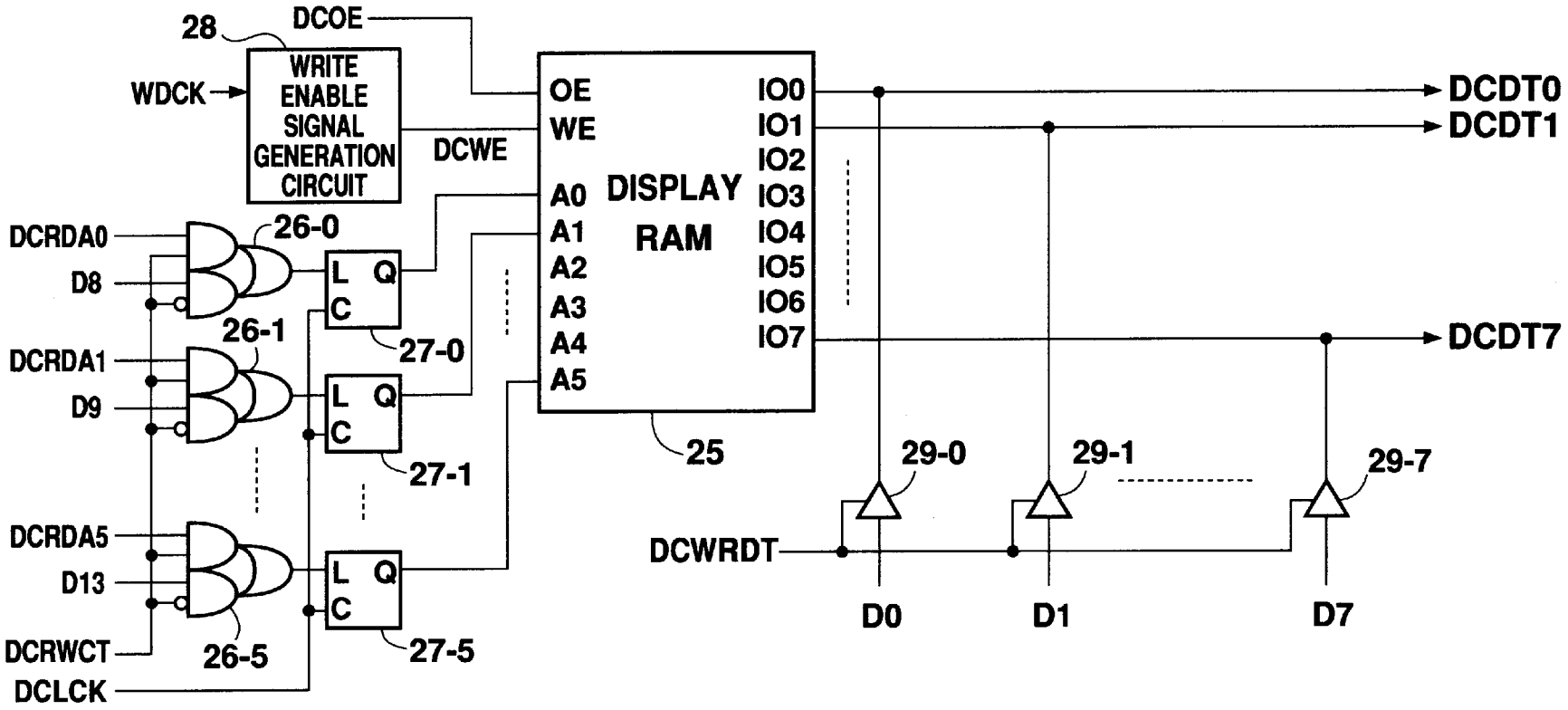
FIG. 11 is a diagram shown in detail the display RAM shown in FIG. 8.

FIG. 4 shows a specific example of a display RAM 38, in which identical members to those shown in FIG. 11 are given identical reference numerals and their explanations will not be repeated here.

Switching circuits 60-0 to 26-7 each comprise three AND gates and one OR gate. The rightmost AND gate of each switching circuit 60-0 to 60-7 receives via one input terminal thereof a signal SCL24B, and receives via another input terminal thereof a corresponding output D0 to D7 from the latch circuit 62. The middle AND gate receives via one input terminal thereof a signal SCL16B, and receives via another input terminal thereof a corresponding output D8 to D15 from the latch circuit 62. The leftmost AND gate receives via one input terminal thereof a signal SCL08B, and receives via another input terminal thereof a corresponding output C16 to S23 from the latch circuit 62. Output terminals of the OR gates of the switching circuits 60-0 to 60-7 are connected to the input terminals of the buffers 29-0 to 29-7, respectively. Note that the display RAM 38 operates for writing and reading in basically the same manner as the display RAM 14.

Figure 5:
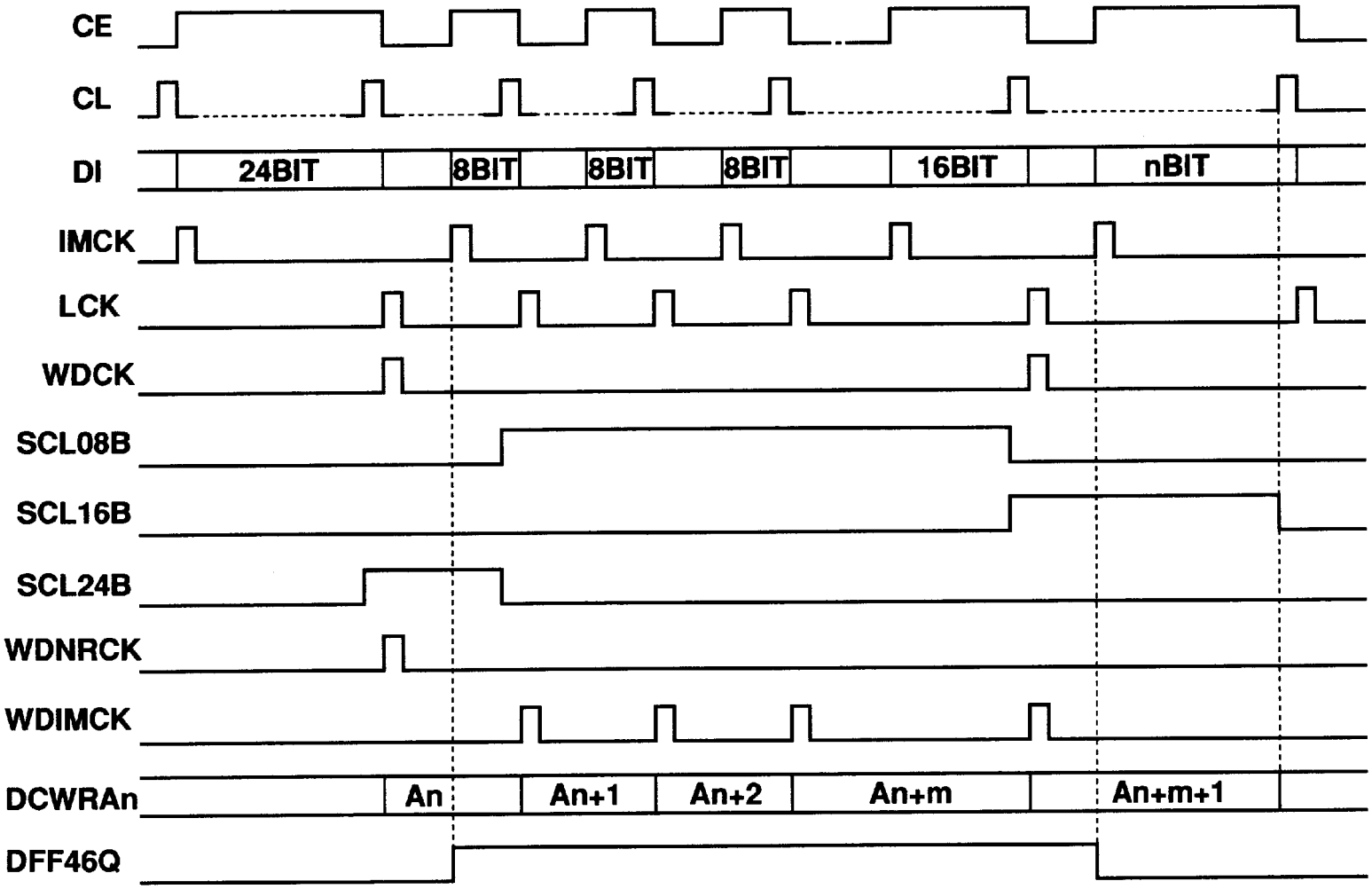
FIG. 5 is a timing chart for a write operation with respect to the display RAM shown in FIG. 1.

Operation of the display RAM 38 will be described referring to the timing chart shown in FIG. 5.

When an operation enable signal CE becomes H level in the interface circuit 1, 24-bit data DI, namely D0 to D23 (an instruction code D20 to D23, a control bit D16, address data D8 to D13, and a character code D0 to D7), are transferred to the shift register 11 in synchronism with a clock signal CL, in which the instruction code D20 to D23 is used for generation of an instruction signal WDCK, and the control bit D16 then remains at an H level. With shift operation completed by the shift register 11, following the generation of a signal SCL24B, an instruction signal WDNRCK is generated by the instruction decoder 40 at the same timing as an instruction signal WDCK. Note that an instruction code WDIMCK is not then generated as an output from the D-type flip flop 46 then remains at an L level. Referring to FIG. 3, receiving an instruction signal WDNRCK, the write address counter 58 for the display RAM 38 outputs address data D8 to D13 intact as DCWRA0 to DCWRA5. Then, referring to FIG. 4, when a switching signal DCRWCT becomes L level, the values DCWRA0 to DCWRA5 of the address counter 58 are output from the switching circuit 26-0 to 26-5, and then latched, when a clock signal DCLCK thereafter becomes H. by the latch circuits 27-0 to 27-5 whereby a write start address An corresponding to address data DCWRA0 to DCWRA5 among all addresses is designated. Subsequently, when a write enable signal DCWE becomes H level after generation of an instruction signal WDNRCK, a character code D0 to D7 is written at the write start address in the display RAM 38 via the switching circuits 60-0 to 60-7 and the buffers 29-0 to 29-7.

Thereafter, when the operation enable signal CE changes from L to H level, a signal IMCK is generated, and an output from the D-type flip flop 46 becomes H level. Meanwhile, eight-bit data DI, i.e., a character code D16 to D23, is solely transferred to the shift register 11 in synchronism with a clock signal CL. Note that an instruction code, a control bit, and address data are then unnecessary. With shift operation completed by the shift register 11, following the generation of a signal SCL08B, an instruction signal WDIMCK is generated by the instruction decoder 40 at the same timing as a signal LCK. Note that the signal SCL24B will lapse upon generation of a signal SCL08B. Referring to FIG. 3, upon receipt of an instruction signal WDIMCK, the write address counter 58 for the display RAM 38 outputs present address data DCWRA0 to DCWRA5, indicative of a write start position, with an increment by one. Referring to FIG. 4, when a switching signal DCRWCT becomes L, the values DCWRA0 to DCWRA5 of the address counter 58 are output from the switching circuit 26-0 to 26-5, and then latched, when a clock signal DCLCK thereafter becomes H level, by the latch circuits 27-0 to 27-5 whereby an address (An+1) immediately after the write start address in the display RAM 38 is designated. Subsequently, when a write enable signal DCWE became H level after generation of an instruction signal WDIMCK, a character code D16 to D23 is written at the address (An+1) in the display RAM 38 via the switching circuits 60-0 to 60-7 and the buffers 29-0 to 29-7.

Thereafter, an eight-bit character code is transferred to the shift register 11 so that a signal LCK is generated upon completion of the shift operation by the shift register 11, and an instruction signal WDIMCK is also generated at the same time of the signal LCK. Accordingly, the address with the display RAM 38 is incremented by one, so that a character code D16 to D23 is written at the incremented address.

For ending writing to the display RAM 38, in response to an operation enable signal CE changing to H level, sixteen-bit data D8 to D23 (an instruction code D20 to D23, a control bit D16, and a character code D8 to D15) are transferred to the shift register 11 in synchronism with a clock signal CL, in which the instruction code D20 to D23 is used for generation of an instruction signal WDCK, and the control bit D16 then remains at an L level. With shift operation completed by the shift register 11, following the generation of a signal SCL16B, an instruction signal WDIMCK is generated by the instruction decoder 40 at the same timing as an instruction signal WDCK. Referring to FIG. 3, upon an instruction signal WDIMCK, the write address counter 58 for the display RAM 38 outputs present address data DCWRA0 to DCWRA5 with an increment by one. Then, referring to FIG. 4, when a switching signal DCRWCT becomes L level, the values DCWRA0 to DCWRA5 of the address counter 58 are output from the switching circuit 26-0 to 26-5, and then latched, when a clock signal DCLCK thereafter becomes H level, by the latch circuits 27-0 to 27-5 thereby designating the next address (An+m+1) in the display RAM 38. Subsequently, when a write enable signal DCWE becomes H level after generation of an instruction signal WDIMCK, a character code D8 to D15 is written at the address (An+m) in the display RAM 38 via the switching circuits 60-0 to 60-7 and the buffers 29-0 to 29-7.

Thereafter, when the operation enable signal CE changes from L to H level and a signal IMCK is generated, an output from the D-type flip flop 46 becomes L level. Thereupon, generation of an instruction signal WDIMCK is stopped, completing the write operation sequence.

Note that since the latch circuit 62 holds values DO to D23 of the shift register 11 and the latch circuit 63 holds signals SCL24B, SCL16B, SCL09B, write operation into the display RAM 38 is carried out during a period from the completion of shift operation by the shift register 11 using various data SDI in connection with the current display to the completion of the shift operation using various data SDI in connection with the next display, where an operation enable signal CE remains at an L or H level.

Figure 6:
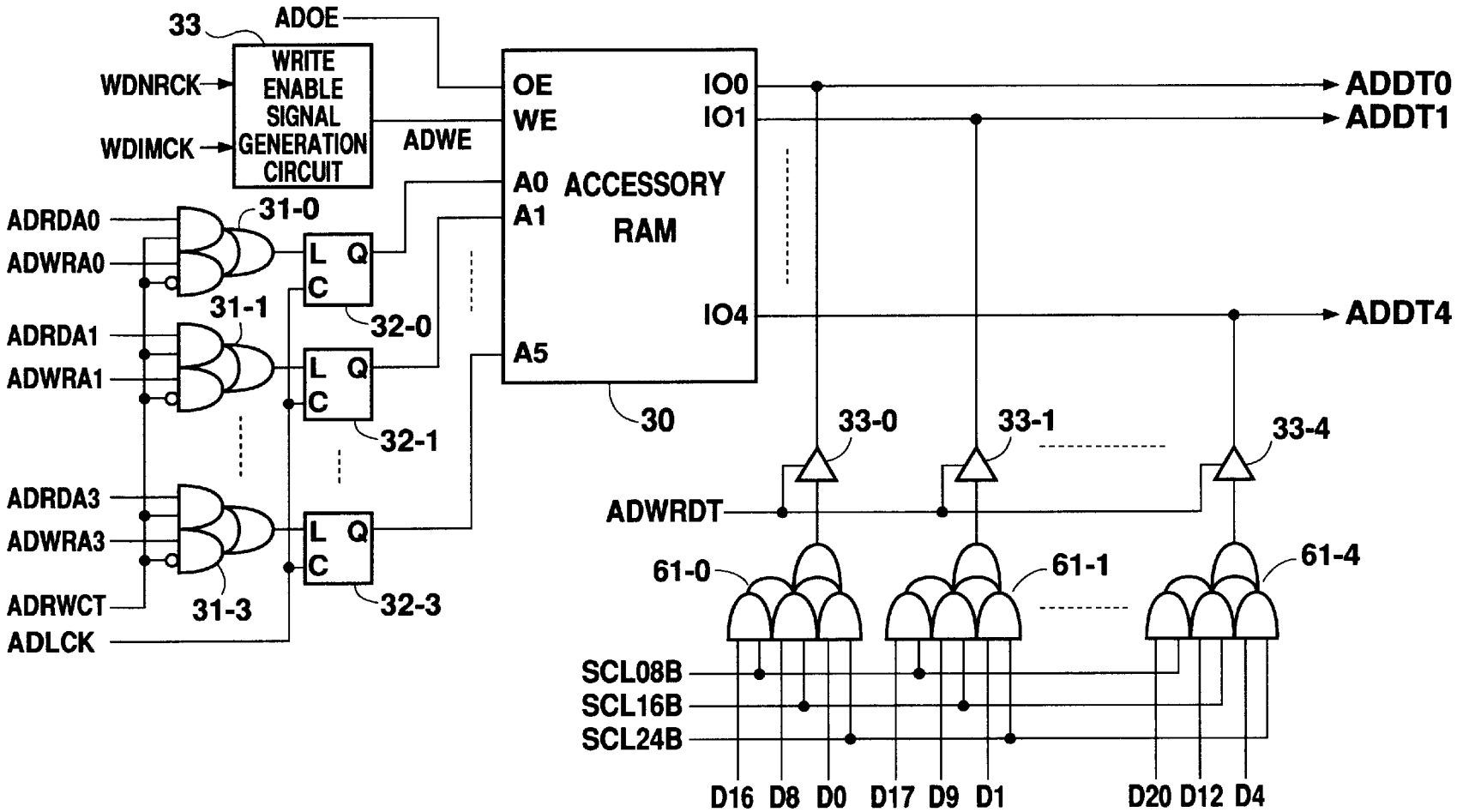
FIG. 6 is a diagram showing in detail the accessory RAM shown in FIG. 1.
Figure 12:
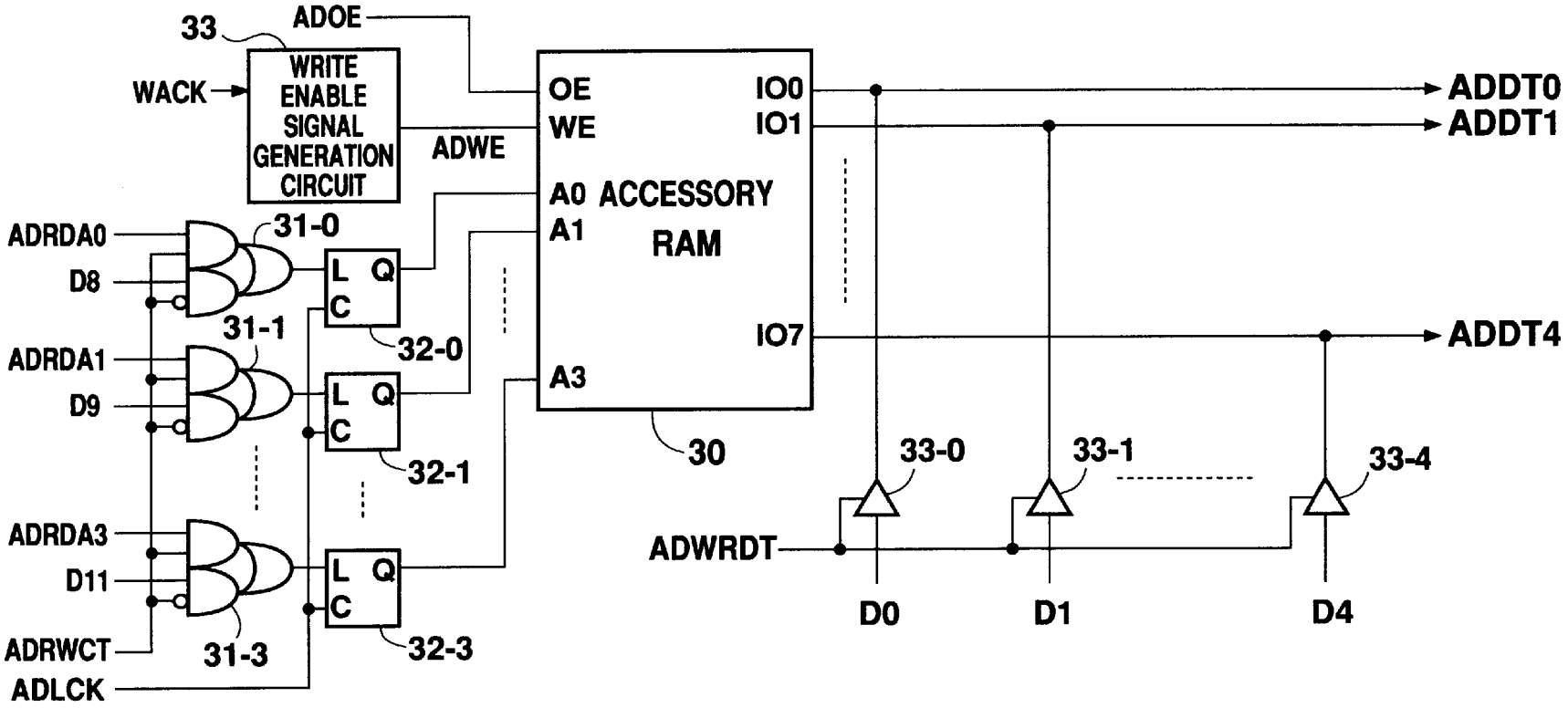
FIG. 12 is a diagram showing in detail the accessory RAM shown in FIG. 8.

FIG. 6 shows a specific example of an accessory RAM 39, in which identical members to those shown in FIG. 12 are given identical reference numerals and their explanations will not be repeated here.

Switching circuits 61-0 to 61-4 each comprise three AND gates and one OR gate. The rightmost AND gate of each switching circuit 61-0 to 61-4 receives, via one input terminal thereof, a signal SCL24B, and receives via another input terminal thereof a corresponding output D0 to D4 from the latch circuit 62. The middle AND gate of each pair receives, via one input terminal, a signal SCL16B, and receives via another input terminal a corresponding output D8 to D12 from the latch circuit 62. The leftmost AND gate receives, via one input terminal thereof, a signal SCL08B, and receives via another input terminal thereof a corresponding output D16 to D20 from the latch circuit 62. Output terminals of the OR gates of the switching circuits 61-0 to 61-4 are connected to the input terminals of the buffers 33-0 to 33-4, respectively. Note that the accessory RAM 39 operates for writing and reading in basically the same manner as the display RAM 38.

Figure 7:
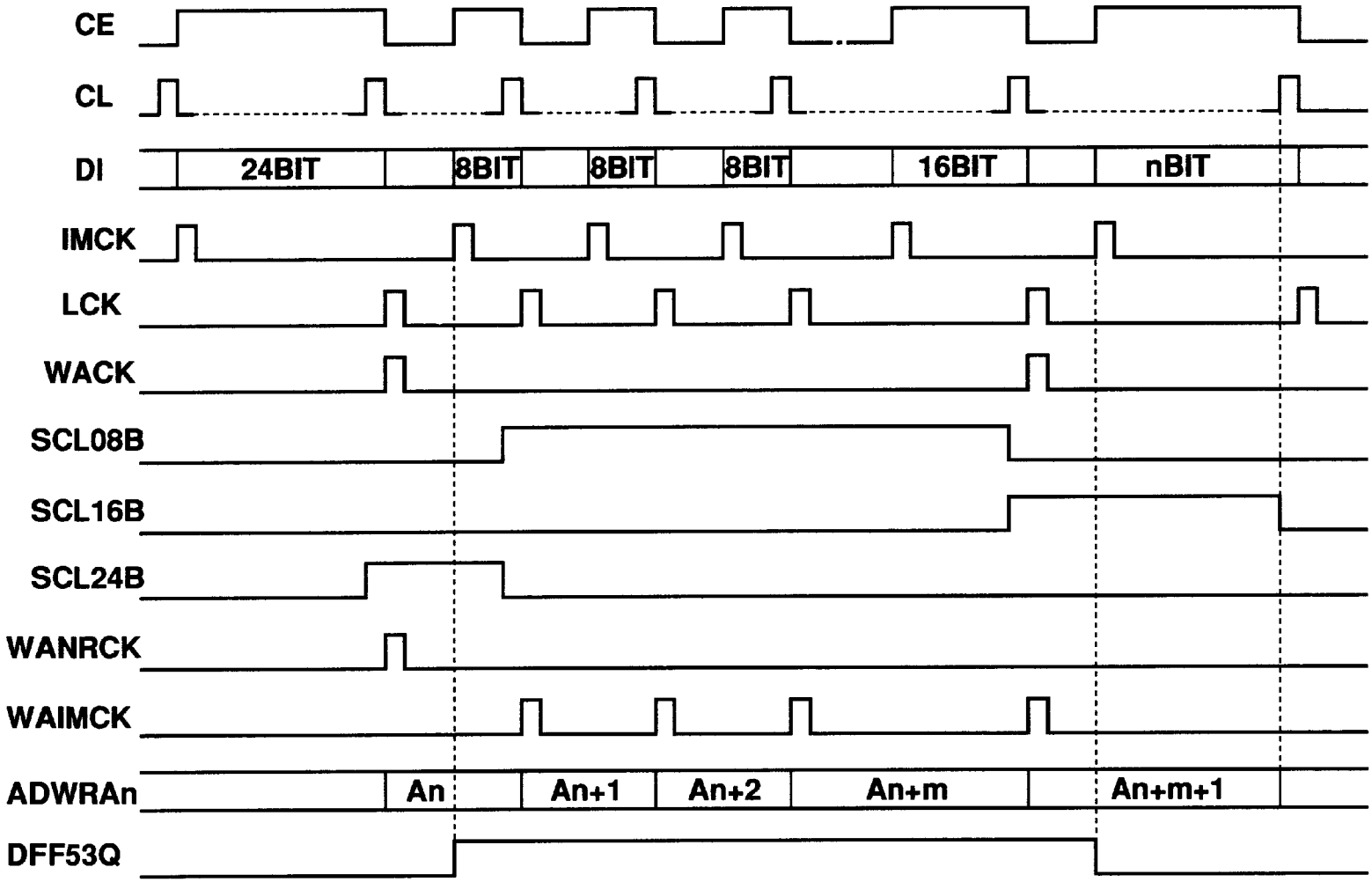
FIG. 7 is a timing chart for a write operation with respect to the accessory RAM shown in FIG. 1.

Operation of the accessory RAM 39 will be described referring to the timing chart shown in FIG. 7.

When an operation enable signal CE becomes H level in the interface circuit 1, 24-bit data DI, namely D0 to D23 (an instruction code D20 to D23, a control bit D16, address data D8 to D11, and an accessory code D0 to D4), are transferred to the shift register 11 in synchronism with a clock signal CL, in which the instruction code D20 to D23 is used for generation of an instruction signal WACK, and the control bit D16 then remains at an H level. With shift operation completed by the shift register 11, following the generation of a signal SCL24B, an instruction signal WANRCK is generated by the instruction decoder 40 at the same timing as an instruction signal WACK. Note that an instruction code WAIMCK is not then generated as an output from the D-type flip flop 53 then remains at an L level. Referring to FIG. 3, upon receiving an instruction signal WANRCK, the write address counter 59 for the accessory RAM 39 outputs address data D8 to D11 intact as ADWRA0 to ADWRA3. Then, referring to FIG. 6, when a switching signal ADRWCT becomes L level, values ADWRA0 to ADWRA3 of the address counter 59 are output from the switching circuit 31-0 to 31-3, and then latched, when a clock signal ADLCK thereafter becomes H level, by the latch circuits 32-0 to 32-3 thereby designating a write start address An corresponding to the accessory data ADWRA0 to ADWRA3 among all addresses. Subsequently, when a write enable signal ADWE becomes H level, following the generation of an instruction signal WANRCK, accessory data D0 to D4 are written at the write start address in the accessory RAM 39 via the switching circuits 61-0 to 61-4 and the buffers 33-0 to 33-4.

Thereafter, when the operation enable signal CE changes from L to H level, a signal IMCK is generated, and an output from the D-type flip flop 53 becomes H level. Meanwhile, eight-bit data DI is transferred (in actual fact, four-bit accessory data D16 to D20 is transferred) to the shift register 11 in synchronism with a clock signal CL. Note that an instruction code, a control bit, and address data are then unnecessary. With shift operation completed by the shift register 11, following the generation of a signal SCL08B, an instruction signal WAIMCK is generated by the instruction decoder 40 at the same timing as a signal LCK. The signal SCL24B will lapse upon generation of the signal SCL08B. Referring to FIG. 3, upon receiving an instruction signal WAIMCK, the write address counter 59 for the accessory RAM 39 outputs the present address data ADWRA0 to ADWRA5, indicative of a write start position, with an increment by one. Referring to FIG. 6, when a switching signal ADRWCT becomes L level, the values ADWRA0 to ADWRA3 of the address counter 59 are output from the switching circuit 31-0 to 31-3, and then latched, when a clock signal ADLCK thereafter becomes H level, by the latch circuits 32-0 to 32-3 thereby designating an address (An+1) immediately after the write start address in the accessory RAM 39. Subsequently, when a write enable signal ADWE becomes H level after generation of an instruction signal WAIMCK, accessory data D16 to D20 are written at the address (An+1) in the accessory RAM 39 via the switching circuits 61-0 to 61-4 and the buffers 33-0 to 33-4.

Thereafter, eight-bit accessory data is transferred to the shift register 11 so that a signal LCK is generated upon completion of the shift operation by the shift register 11, and an instruction signal WAIMCK is also generated at the same time of the signal LCK. Accordingly, the address with the accessory RAM 39 is incremented by one, so that accessory data D16 to D20 is written at the incremented address.

For ending writing to the accessory RAM 39, in response to an operation enable signal CE becoming H level, sixteen-bit data D8 to D23 (an instruction code D20 to D23, a control bit D16, a character code D8 to D12) are transferred to the shift register 11 in synchronism with a clock signal CL, in which the instruction code D20 to D23 is used for generation of an instruction signal WACK, and the control bit D16 then remains at an L level. With a shift operation completed by the shift register 11, following the generation of a signal SCL16B, an instruction signal WAIMCK is generated by the instruction decoder 40 at the same timing as an instruction signal WACK. Referring to FIG. 3, upon receiving an instruction signal WAIMCK, the write address counter 59 for the accessory RAM 39 outputs present address data ADWRA0 to ADWRA3 with an increment by one. Then, referring to FIG. 6, when a switching signal ADRWCT becomes L level, the values ADWRA0 to ADWRA3 of the address counter 59 are output from the switching circuit 31-0 to 31-3, and then latched, when a clock signal ADLCK thereafter becomes H level, by the latch circuits 32-0 to 32-3 thereby designating the next address (An+m+1) in the accessory RAM 39. Subsequently, when a write enable signal ADWE became H level after generation of an instruction signal WAIMCK, a character code D8 to D12 is written at the address (An+m) in the accessory RAM 39 via the switching circuits 61-0 to 61-4 and the buffers 33-0 to 33-4.

Thereafter, when the operation enable signal CE changes from L to H level, and a signal IMCK is generated, an output from the D-type flip flop 53 becomes L level. Thereupon, generation of an instruction signal WAIMCK is stopped, completing the write operation sequence.

Note that since the latch circuit 62 holds values DO to D23 of the shift register 11 and the latch circuit 63 holds signals SCL24B, SCL16B, SCL08B, a write operation into the accessory RAM 39 is also carried out during a period from the completion of a shift operation by the shift register 11 using various data SDI in connection with the current display to the completion of the shift operation using various data SDI in connection with the next display, where an operation enable signal CE remains at an L or H level.

As described above, according to the preferred embodiment of the present invention, a write operation is carried out during a period when an operation enable signal CE remains at either an L or H level. With this arrangement, time allowance for writing can be ensured, which enables reduction of the software processing load by an external device.

Note that the term "display memory" refers to a display RAM or an accessory RAM.

What is claimed is:

1. A display driving circuit for displaying a predetermined character on a display panel, comprising:

a shift register for serially receiving display data during a period when an operation enable signal remains at one logical level;

a latch circuit for latching the display data from said shift register in synchronism with a timing at which the operation enable signal changes from the one logical level to another logical level;

a display memory for being written the display data from said latch circuit; and a panel driving circuit for displaying on the display panel a character corresponding to the display data read from said display memory.

2. A circuit according to claim 1, wherein said shift register receives address data indicative of a write start address for the display data as well as the display data.

3. A circuit according to claim 2, further comprising a write address counter for receiving the address data indicative of a write start address supplied to said shift register, and for sequentially changing the address data for designation of a write address in said display memory.

4. A circuit according to claim 3, wherein said shift register receives instruction data including a write instruction for the display data as well as the display data and the address data, and said circuit further comprises an instruction decoder for decoding the instruction data to generate a signal including a write enable signal.

5. A circuit according to claim 4, wherein the display data, the address data, and the instruction data are input into said shift register when starting writing of the display data into said display memory, the display data is sequentially input into said shift register during the writing, and the display data and instruction data are input into said shift register when ending the writing.

6. A circuit according to claim 1, wherein input of the next display data into said shift register is carried out in parallel to writing of the current display data from said latch circuit to said display memory.

* * * * *